US005296441A

United States Patent [19]

Yoshida et al.

[11] Patent Number: 5,296,441

[45] Date of Patent: Mar. 22, 1994

[54] THERMAL PRINTING MEDIUM AND METHOD FOR PREPARING THE SAME

[75] Inventors: Mitsuhiro Yoshida; Tatsuhiro Yamaguchi; Takayuki Norizuki, all of Shizuoka, Japan

[73] Assignee: Tomoegawa Paper Co., Ltd., Tokyo, Japan

[21] Appl. No.: 22,375

[22] Filed: Feb. 25, 1993

[30] Foreign Application Priority Data

Feb. 28, 1992 [JP] Japan ..... 4-75970
May 22, 1992 [JP] Japan ..... 4-154201

[51] Int. Cl.[5] ..... B41M 5/035; B41M 5/38

[52] U.S. Cl. ..... 503/216; 427/150; 427/152; 503/225; 503/226

[58] Field of Search ..... 427/150–152; 503/210–212, 216, 217, 200, 226, 209

[56] References Cited

U.S. PATENT DOCUMENTS 4,772,581 9/1988 Miyauchi et al. ..... 503/200

*Primary Examiner*—B. Hamilton Hess

*Attorney, Agent, or Firm*—Oblon, Spivak, McClelland, Maier & Neustadt

[57] ABSTRACT

A thermal printing medium comprising a substrate having an upper and lower surface;

a heat sensitive layer formed over at least one surface of said substrate and including at least one of a colorless and a lightly colored leuco dye, and a color developing agent which imparts color to said leuco dye; and a protective layer comprised of aqueous resin and filler agent as main components thereof;

characterized in that said heat sensitive layer is comprising at least one compound indicated by formula (1)

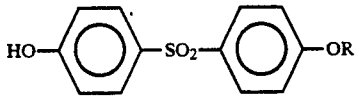

(1)

(wherein R indicates an alkyl group having 1 to 10 carbon atoms or a benzyl group which may have a substitutional group) as a color developing agent, and aluminum hydroxide.

6 Claims, No Drawings

THERMAL PRINTING MEDIUM AND METHOD FOR PREPARING THE SAME

BACKGROUND OF THE INVENTION

Field of the Invention

The present invention relates to a thermal printing medium comprising a heat sensitive layer and a protective layer disposed on a substrate. More specifically, the present invention relates to a thermal printing medium exhibiting excellent printing stability such as no blurring of letters, high sensitivity, excellent water resistance, resistance to water dissolved plasticizer, as well as excellent chemical resistance and oil resistance. In particular, the present invention relates to a thermal printing medium having suitable characteristics for a thermally printed-type label, and a method for preparing the same.

In general, a thermal printing medium having a heat sensitive layer chiefly comprised of a colorless or a light colored leuco dye, and a color developing agent which imparts color to the leuco dye by thermally reacting with the leuco dye, is disclosed in Japanese Patent First Publication Serial No. 45- 14035. Such a thermal printing medium is used in a great variety of printing applications. In order to print on this thermal printing medium, a thermal printer device with a built-in thermal head is used. Such a thermal printing technique has many advantages, such as producing low noise, requiring no fixing development process, requiring little maintenance, is relatively inexpensive, may be of compact design, and the color of the produced images is very clear compared to that of other ordinary printing techniques. Therefore, thermal printing media are used in a great variety of printing applications, including computer hard copy, facsimile devices, numerous types of measuring instruments which produce printed output, and labels.

However, because the color-producing reaction in the heat sensitive layer, wherein a reaction occurs between the leuco dye and the color developing agent, is reversible, when the thermal printing medium is used under extreme conditions or when the medium contacts certain chemicals, the color-producing reaction may be readily reversed. As a result, the colored images may disappear. Therefore, it is difficult to maintain the thermal printing medium in good condition. In fact, for example, when the thermal printing medium contacts plasticizer included in wrapping films comprised of polyvinyl chloride, fats and oils included in edible lipids, industrial oils, or adhesive agents included in adhesive tapes or glue sticks, the colored images may readily disappear. In order to more widely use the thermal printing medium by improving the chemical resistance thereof, Japanese Patent Second Publication Serial No. 57-188392 for example, proposes a thermal printing medium in which a protective layer is formed over the heat sensitive layer to prevent the penetration of lipophilic chemicals such as plasticizers, oils or the like into the heat sensitive layer.

The stability of images of the thermal printing medium against the lipophilic chemicals of edible fats and the like is improved by forming the protective layer over the heat sensitive layer. However, in the case in which the thermal printing medium is used a label on food, when the label is soaked in water for a prolonged period, the water resistance of the label decreases. Moreover, because the plasticizer included in the food wrapping film diffuses into water and adheres to the label, resistance to water dissolved plasticizer of the food wrapping film is decreased. Therefore, the stability of preservation of the thermal printing medium is not improved satisfactorily by forming the protective layer over the heat sensitive layer. Because the substrate is made of paper and the protective layer is made of aqueous resin namely water soluble resin or water dispersed resin, the water resistance of the substrate and the protective layer is high. Therefore the heat sensitive layer is influenced easily with water or plasticizer dissolved in water.

Moreover a color developing agent is used to improve above-mentioned high water resistance. For examples, as the color developing agent, in particular 2,2'-bisphenolsulfone and 2,2'-bisphenolsulfide compounds are used (Japanese Patent Second Publication Serial No.56-30896). Certain kind of 4,4'-bisphenolsulfide compounds are used (Japanese Patent Second Publication Serial No.57-41996). Bis(3-allyl-4-hydroxyphenyl)sulfone is used (Japanese Patent Second Publication Serial No.60-208286). Many other examples suggest the compounds as the color developing agent. However, when above-mentioned compounds are used as the color developing agent, the water resistance is improved, but the fog appears in the background of the medium. Moreover, when the protective layer is formed over the heat sensitive layer, printing sensitivity and printing density of the thermal printing media are deteriorated.

In this way, in spite of many countermeasure are tried to make excellent thermal printing media, in fact the thermal printing medium having satisfactory printing sensitive characteristic, excellent chemical resistance and oil resistance, little fog of background, as well as excellent water resistance and resistance to water dissolved plasticizer, cannot be obtained.

SUMMARY OF THE INVENTION

In order to achieve the above described objects, the present invention provides a thermal printing medium having characteristics needed for thermal sensitive-type labels such as excellent chemical resistance, excellent oil resistance, high printing sensitivity, high whiteness of the background, excellent water resistance and resistance to water dissolved plasticizer. Moreover the present invention provides a method for preparing the same.

According to a first aspect of the present invention, a thermal printing medium is provided, comprising of a substrate having an upper and a lower surface; a heat sensitive layer formed over at least one surface of said substrate and including at least one of a colorless and a lightly colored leuco dye, and a color developing agent which imparts color to said leuco dye as main components thereof; and a protective layer comprised of aqueous resin and filler agent as main components thereof; characterized in that said heat sensitive layer is comprising at least one compound indicated by formula (1)

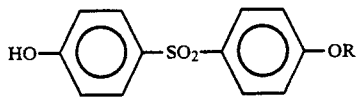

(1)

(wherein R indicates an alkyl group having 1 to 10 carbon atoms or a benzyl group which may have a substitutional group) as the color developing agent, and aluminum hydroxide.

According to a second aspect of the present invention, a thermal printing medium is provided which comprises a heat sensitive layer including a color developing agent and aluminum hydroxide at a ratio 100 : 10 to 300.

According to a third aspect of the present invention, a thermal printing medium is provided comprising a heat sensitive layer including a color developing agent and aluminum hydroxide at a ratio 100 : 20 to 150.

According to a fourth aspect of the present invention, a thermal printing medium is provided in which the color developing agent is 4-hydroxy-4'-isopropoxydiphenylsulfone.

According to a fifth aspect of the present invention, a method for obtaining a thermal printing medium is provided, comprising the steps of:

forming a heat sensitive layer over at least one surface of a substrate, the heat sensitive layer including at least one of a colorless and a lightly colored leuco dye, and a color developing agent which imparts color to the leuco dye, as main components thereof;

forming a protective layer over the heat sensitive layer, which is comprised of aqueous resin and filler agent as main components thereof;

characterized in that in forming the heat sensitive layer, a coating for forming the heat sensitive layer is prepared by blending a dispersed solution ground by a media-type wet grinding machine is used, the dispersed solution comprising of at least one composition indicated by formula (1)

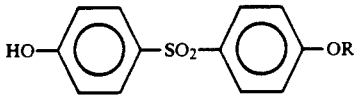

(1)

(wherein R indicates an alkyl group having 1 to 10 carbon atoms or a benzyl group which may have a substitutional group) as the color developing agent, aluminum hydroxide, and a dispersant.

According to a sixth aspect of the present invention, a method for obtaining a thermal printing medium is provided, comprising the steps of:

forming the heat sensitive layer over at least one surface of the substrate, the heat sensitive layer including at least one of a colorless and a lightly colored leuco dye, and a color developing agent which imparts color to the leuco dye, as main components thereof;

forming a protective layer over said heat sensitive layer, which is comprised of aqueous resin and filler agent as main components thereof;

characterized in that in forming the heat sensitive layer, a coating for forming the heat sensitive layer is prepared by a blending dispersed solution ground by a media-type wet grinding machine is used, the dispersed solution comprising at least one composition indicated by formula (1)

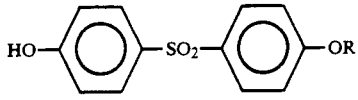

(1)

(wherein R indicates an alkyl group having 1 to 10 carbon atoms or a benzyl group which may have a substitutional group) as the color developing agent, aluminum hydroxide, and a dispersant which is at least one kind of ammonium salt selected from the group comprising (di)isobutylene-maleic anhydride copolymer, styrene-mono maleate copolymer, styrene-(meta)acrylic acid copolymer, and styrene-(meta)acrylic acid-(meta)acrylamide copolymer.

DETAILED DESCRIPTION OF THE PREFERRED EMBODIMENTS

Representative examples of the diphenylsulfone compounds indicated by the formula (I) used as the color developing agent included in the heat sensitive layer include, but are not limited to, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-n-propoxydiphenylsulfone, 4-hydroxy-4'-n-butoxydiphenylsulfone, 4-hydroxy-4'-n-pentyloxydiphenylsulfone, 4-hydroxy-4'-n-hexyldiphenylsulfone, 4-hydroxy-4'-n-heptyloxydiphenylsulfone, 4-hydroxy-4'-n-octyloxydiphenylsulfone, 4-hydroxy-4'-n-nonyloxydiphenylsulfone, 4-hydroxy-4'-n-decyloxydiphenylsulfone, 4-hydroxy-4'-benzyloxydiphenylsulfone, 4-hydroxy-4'-(4-methylbenzyloxy)diphenylsulfone, 4-hydroxy-4'-(4-methoxybenzyloxy)diphenylsulfone, 4-hydroxy-4'-(4-chlorobenzyloxy)diphenylsulfone, 4-hydroxy-4'-(2,6-dimethylbenzyloxy)diphenylsulfone and the like. In particular, 4-hydroxy-4'-isopropoxydiphenylsulfone is preferable, because the compound is stable, has high printing sensitivity, and is smudge resistant. These characteristics are well-balanced.

Aluminum hydroxide included in the heat sensitive layer of the present invention is indicated by the chemical formula of $Al(OH)_3$, and is an inorganic pigment having a monoclinic system crystal form. For example Hygillite (trade name, marketed by Showa Denko Co.) is used as the aluminum hydroxide. In the present invention, the thermal printing medium which exhibits little smudging of the background and has high thermal sensitivity, printing stability, particularly excellent water resistance, and resistance to water dissolved plasticizer are provided by the combination of the color developing agent indicated by formula (I) and aluminum hydroxide. The ratio between the color developing agent indicated by formula (I) and aluminum hydroxide is preferably 100 : 10 to 300, and more preferably 100 : 20 to 150. When the ratio of parts aluminum hydroxide per 100 of the color developing agent is less than 10, a problem may arise in that the water resistance, resistance to water dissolved plasticizer, and the whiteness of the background are not satisfactorily improved. When the ratio is more than 300, because the amount of the aluminum hydroxide as filler is excessive, it is likely to deteriorate the printing sensitivity of the thermal printing medium.

All leuco dyes used for a thermal printing media may be in the present invention. Representative examples of leuco dyes include fluoran compounds, triarylmethanphthalide compounds, fluorenephthalide compounds, divinylphthalide compounds, phenothiazine compounds, auramine compounds, spiropyrane compounds and rhodaminelactam compounds. Concretely, examples of leuco dyes include fluoran compounds such as 3-diethylamino-6-methyl-7-anilinofluoran, 3-di-n-butylamino-6-methyl-7-anilinofluoran, 3-di-n-pentyl-6-methyl-7-anilinofluoran, 3-N-ethyl-N-isopropylamino-6-methyl-7-anilinofluoran, 3-N-ethyl-N-isoamylamino-6-methyl-7-anilinofluoran, 3-N-methyl-N-cyclohexylamino-6-methyl-7-anilinofluoran, 3-N-methyl-N-isobutylamino-6-methyl-7-anilinofluoran, 3-N-ethyl-N-p-tolylamino-6-methyl-7-anilinofluoran, 3-N-pyrrolidino-N-methylamino-6-methyl-7-anilinofluoran, 3-N-piperidino-N-methylamino-6-methyl-7-anilinofluoran, 3-N-ethyl-N-tetrahydrofurfurylamino-6-methyl-7-anilinofluoran, 3-diethylamino-6-chloro-7-anilinofluoran, 3-N-ethyl-N-(2-ethoxypropyl)amino-6-methyl-7-anilinofluoran, 3-diethylamino-6-methyl-7-(o-chloroanilino)fluoran, 3-di-n-butylamino-6-methyl-7-(o-chloroanilino)fluoran, 3-diethylamino-6-methyl-7-(o-trifluoromethylanilino)fluoran, 3-diethylamino-7-chlorofluoran, 3-diethylamino-6-methyl-7-chlorofluoran, 3-cyclohexylamino-6-chlorofluoran, 3-N-ethyl-N-p-tolylamino-7-methylfluoran, 3-diethylamino-7,8-benzofluoran, 3-diethylamino-7-t-butylfluoran, 3-N-ethyl-p-tolylamino-7-N-methyl-N-phenylaminofluoran, 3-diethylamino-7-dibenzylaminofluoran, 2-methyl-6-p-(p-dimethylaminophenyl)aminoanilinofluoran, 2-chloro-3-methyl-6-p-(p-dimethylaminophenyl)aminoanilinofluoran and the like, triarylmethanphthalide compounds such as 3,3'-bis(p-dimethylaminophenyl)phthalide, 3,3'-bis(p-dimethylaminophenyl)-6-dimethylaminophthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and the like, fluorenephthalide compounds such as 3,6-bis(dimethylamino)fluorene-9-spiro-3'-(6'-dimethylamino)phthalide, 3,6-bis(diethylamino) spiro-3'-(6'-diethylamino)phthalide and the like, divinylphthalide compounds such as 3,3-bis[2-(p-dimethylaminophenyl)-2-(p-methoxyphenyl)ethenyl]-4,5,6,7-tetrachlorophthalide, 3,3-bis[2-(p-dimethylaminophenyl)-2-(p-methoxyphenyl)ethenyl]-4,5,6,7-tetrabromophthalide, 3,3-bis[2-(p-pyrrolidinophenyl)-2-(p-methoxyphenyl)ethenyl]-4,5,6,7-tetrachlorophthalide and the like, phenothiazine compounds such as benzoyleucomethyleneblue and the like, auramine compounds such as 4,4'-bisdimethylaminobenzohydrylbenzylether, N-halophenyl-leucoauramine and the like, spiropyrane compounds such as 3-methyl-spiro-dinaphthopyrane and 3-ethyl-spirodinaphthopyrane and the like, and lactam compounds such as rhodamine B-anilinolactam, rhodamine(p-nitroanilino)lactam and the like. In particular, leuco dyes comprised of fluoran compounds can themselves turn black. Moreover, the stability of images caused by the fluoran compounds is superior to that of the other compounds. Therefore the leuco dye comprised of fluoran compounds are especially desirable.

All of the constituents making up the heat sensitive layer are held together using a binder agent. Aqueous resin, namely, water soluble resin or water dispersed resin, is used for the binder agent of the heat sensitive layer of the thermal printing media of the present invention. Examples of suitable binder agents are polyvinyl alcohol, modified polyvinyl alcohol, hydroxyethylcellulose, methylcellulose, carboxymethylcellulose, starch, derivatives of starch, casein, gelatin, sodium alginate, polyvinylpyrolidone, polyacrylamide, modified polyacrylamide, water soluble resins such as alkalinized solution of isobutylene-maleic anhydride resin, alkalinized solution of diisobutylene-maleic anhydride resin, alkalinized solution of styrene-maleic anhydride resin and the like, and water dispersed resin such as polyester, polyurethane, (meta)acrylate copolymer, styrene-(meta)acrylate copolymer, polyvinyl acetate, polyvinylidene chloride and their derivatives or the like, as well as mixtures of any of the preceding.

In the present invention, in order to improve the printing sensitivity, a variety of heat fusible materials can be added to the heat sensitive layer, depending on the situation. Examples of suitable organic compounds having suitable melting points include higher fatty acid amidos such as stearamide, N-methylolated stearamide and the like, higher fatty acids, higher fatty acid esters, aromatic carboxylates such as dimethylterephthalate, diphenylphthalate and the like, diarylalkylate as dibasic acid of aliphatic compounds such as dibenzyl oxalate, di(p-methylbenzyl) oxalate, naphthalene derivatives such as $\beta$-naphthoic phenyl ether, phenyl $\beta$-naphthoate, phenyl 1-hydroxy-2-naphthoilate and the like, biphenyl derivatives such as p-benzylbiphenyl and the like, terphenyl derivatives or the like.

Moreover, as filler agents, in addition of aluminum hydroxide, organic fillers and inorganic fillers such as heavy calcium carbonate, light calcium carbonate, titanium oxide, zinc oxide, barium sulfate, talc, clay, satin white, kaolinite, polyolefine grains, urea-formalin resin grains and the like can be added to the heat sensitive layer. Moreover, dispersant, surface active agent, antioxidant, ultraviolet absorbent and the like can be added to the heat sensitive layer, depending on the situation.

The resin, which is easily turned into a film and having high chemical resistance, and a filler agent are the main components of the protective layer of the present invention Moreover, in order to obtain high water resistance, a waterproof agent can be added to the layer, depending on the situation. The resin of the protective layer of the present invention comprises at least one kind of resin selected from the group comprised of aqueous resin, namely, water soluble resin and water dispersed resin. Specifically, the resin of the protective layer is the same as the binder agent used in the heat sensitive layer Moreover, organic fillers and inorganic fillers such as heavy calcium carbonate, light calcium carbonate, titanium oxide, zinc oxide, barium sulfate, talc, clay, satin white, kaolinite, polyolefine grain, urea-formalin resin grain and the like can be used as filler agents of the protective layer. Moreover, glyoxal, chromium alum, melamine resin, melamine formaldehyde resin, polyamide resin, polyamide-epichlorohydrine resin, zirconium compounds or the like can be added to the protective layer as a waterproof agent. Moreover, in order to improve the matching property between the thermal printing medium and the thermal head, metallic soap, wax and the like can be added to the protective layer, depending on the situation.

In the following, methods for preparing the thermal printing medium of the present invention will be described in detail.

The thermal printing medium of the present invention is formed by layering the heat sensitive layer on the substrate made up of natural paper, synthesized paper, resin film, their composites, or the like, then layering the protective layer over the heat sensitive layer. The heat sensitive layer is formed by coating the said substrate with the dispersed solution which is comprised of the above-mentioned components by well-know coating methods such as air knife coating, roll coating, bar coating, and blade coating, then drying. Similarly, the protective layer is also formed. The dispersed solution coated over the substrate is prepared as follows. The leuco dye is ground using a media-type wet grinding machine, combining the aqueous resin used as the dispersant and binder agent. The color developing agent indicated by the formula (1) is ground, using a media-type wet grinding machine, combining the aqueous resin used as the dispersant and binder agent. The leuco dye is dispersed until the grain diameter of the dispersed grain becomes equal to or less than 5 μm, and preferably 2 μm. Similarly, the color developing agent is also dispersed. Then the dispersed solution of leuco dye and that of the color developing agent are mixed. The coating for forming the heat sensitive layer (a heat sensitive coating) is prepared by adding a dispersed solution of aluminum hydroxide to the above-mentioned mixture.

Furthermore, in forming the thermal printing medium of the present invention, in order to obtain an improved printing sensitivity, resistance to water dissolved plasticizer and the like, it is preferably to grind using a media-type wet grinding machine, the color developing agent indicated by formula (1), aluminum hydroxide, and dispersant. That is, the heat sensitive coating is prepared by combining the color developing agent indicated by formula (1) with aluminum hydroxide and dispersant, and by grinding them using a media-type wet grinding machine. The obtained mixture of dispersed solution is mixed with the dispersed solution of leuco dye and the other dispersed solution at a desirable ratio. Moreover, representative examples of a media-type wet grinding machine include, but are not limited to, a ball mill, an attritor, a sand grinder, and the like.

In dispersing the color developing agent indicated by formula (1) and aluminum hydroxide, the dispersants used at the same time are water soluble resins such as polyvinylalcohol, its derivatives, cellulose derivatives, (di)isobutylene-maleic anhydride copolymer, styrene copolymer, acryl copolymer and the like. In particular, a solution of (di)isobutylene-maleic anhydride copolymer and styrene copolymer is preferable. That is, a solution of dissolved ammonium salt such as diisobutylene-maleic anhydride copolymer ammonium salt, isobutylene-maleic anhydride copolymer ammonium salt, styrene-mono maleate copolymer ammonium salt, styrene-(meta)acrylic acid copolymer ammonium salt, styrene-(meta)acrylic acid-(meta)acrylamide copolymer ammonium salt and the like are preferable. In particular, the solution of styrene-(meta)acrylic acid-(meta)acrylamide copolymer ammonium salt is preferable. The compound has improved fine grinding ability and stability of dispersed solution, therefore the compound is most preferable among the above-mentioned compounds. The improved properties are obtained because the compound comprises the components of styrene, (meta)acrylic acid, and (meta)acrylamide; the styrene has hydrophobic properties, (meta)acrylic acid has hydrophilic properties and can make the dispersed particles stable ionically, and (meta)acrylamide has hydrophilic properties and can make the dispersed particles stable as protective colloid function, and they are copolymerized moderately The amount of heat sensitive coating of the present invention is 2 to 10 g/m$^2$, preferably 4 to 8 g/m$^2$. On the other hand, the amount of the coating for forming the protective layer (protective coating) is 1 to 10 g/m$^2$. When the amount of coating applied to the protective layer is less than 1 g/m$^2$, the protective layer does not operate as a barrier layer which improves chemical resistance of the thermal printing medium. Moreover, when it is more than 10 g/m$^2$, because the protective layer prevents heat transference to the heat sensitive layer, the printing sensitivity of the thermal printing medium deteriorates. In particular, the amount of protective coating is preferably 2 to 8 g/m$^2$.

Moreover, in order to obtain excellent printing sensitivity by improving the contact between the thermal printing medium and a thermal head, it is desirable to smooth the surface of the protective layer after the heat sensitive layer and the protective layer are formed. In particular, the smoothing treatment is carried out so that the Beck smoothness is equal to 700 seconds or more, and is preferably equal to 1000 seconds or more. A calender machine comprised of a metallic roll and an elastic roll is used for the smoothing treatment.

Moreover, in the thermal printing medium of the present invention, it is possible to improve the resolution of the image by enhancing the smoothness of the surface of substrate. Enhancing the smoothness is achieved by forming an under layer comprised of filler agent and binder agent as main components between the substrate and the heat sensitive layer, depending on the situation. Furthermore, it is possible to prevent disappearance of the color of the printed image and undesired coloring by preventing the infiltration of many kinds of chemicals from the reverse side of the thermal printing medium against the heat sensitive layer. The prevention of the infiltration of chemicals is achieved by forming a back layer comprised of a polymer having a film-forming property as the main component on the surface, wherever the heat sensitive layer is not formed on the substrate.

In the thermal printing medium of the present invention, when the compound indicated by formula (1) is used as the color developing agent for the heat sensitive layer and aluminum hydroxide is included in the heat sensitive layer, the whiteness of the background becomes too high. The supposed reason is that the pH buffer action of aluminum hydroxide prevents the production of fog. The fog is produced by the intense reaction between the leuco dye and the color developing agent indicated by formula (1), which present in the solution for the color developing agent. The reaction also occurs after the heat sensitive layer is formed by coating the heat sensitive coating on the substrate. Moreover, water resistance or resistance to water dissolved plasticizer of the heat sensitive layer is improved. It is supposed that the acid-base coloring reaction between the leuco dye and the color developing agent indicated by formula (1) in the mixed state by heating, is stabilized by the aluminum hydroxide. Therefore, properties of the heat sensitive layer are improved, and a unique image stability is obtained.

The present invention will be explained in detail hereinbelow with reference to the examples In the examples, all "parts" designate "parts by weight".

EXAMPLE 1

In order to prepare the heat sensitive coating, solution [A] and solution [B] having the compositions listed below were dispersed respectively by a sand grinder, and solution [C] was dispersed by homogenizer.

| Solution [A]: | |
|---|---|
| 4-hydroxy-4'-isopropoxydiphenylsulfone | 30 parts |

-continued

| | |
|---|---|
| 30% styrene-mono maleate copolymer ammonium salt solution (trade name Discoat N-14: marketed by Daiichi Kogyoseiyaku Co.) | 10 parts |
| water | 60 parts |
| Solution [B]: | |
| 3-N-ethyl-N-isoamylamino-6-methyl-7-anilinofuluorane | 30 parts |
| 10% polyvinylalcohol solution (trade name PVA203: marketed by Kurare Co.) | 45 parts |
| water | 25 parts |
| Solution [C]: | |
| aluminum hydroxide (trade name Hygillite H-42: Showa Denko Co.) | 30 parts |
| 30% styrene-mono maleate copolymer ammonium salt solution (trade name Discoat N-14: marketed by Daiichi Kogyoseiyaku Co.) | 5 parts |
| water | 65 parts |
| The obtained dispersed solutions [A], [B], [C] and another dispersed solution were mixed in the ratio below. | |
| Dispersed solution [A] | 100 parts |
| Dispersed solution [B] | 30 parts |
| Dispersed solution [C] | 100 parts |
| 25% styrene-acrylic acid-acrylamide copolymer ammonium salt solution (trade name SA-6N-604: marketed by Kindai Chemicals Co.) | 60 parts |

The heat sensitive layer was obtained by heat sensitive coating prepared by the above-mentioned method on the wood free paper having a weight of 56 g/m$^2$ as the substrate, and dried to form a heat sensitive layer, such that the dry weight thereof was 6 g/m$^2$.

A protective layer coating having the composition listed below was obtained.

| | |
|---|---|
| 10% carboxyl modified polyvinylalcohol solution (trade name Gosenol T-330: marketed by Nippon Gosei Kagaku Co.) | 100 parts |
| 40% china clay aqueous dispersed solution | 20 parts |
| 30% zinc stearate aqueous dispersed solution | 5 parts |
| 20% polyamidoepichlorohydrine resin solution (trade name Polyfix 203: marketed by Showa Polymer Co.) | 20 parts |
| water | 15 parts |

Thus prepared, the protective layer material was then coated over the previously prepared thermal sensitive layer and dried to form a protective layer, such that the dry weight thereof was 4 g/m$^2$.

COMPARATIVE EXAMPLE 1

A comparative thermal printing medium was prepared identical to that of Example 1 of the present invention, except that the solution [C] was replaced with the solution [C-1] having the composition listed below.

| Solution [C-1]: | |
|---|---|
| light calcium carbonate (trade name Brilliant 15: marketed by Shiraishi Industries Co.) | 30 parts |
| 30% styrene-mono maleate copolymer ammonium salt solution (trade name Discoat N-14: marketed by Daiichi Kogyoseiyaku Co.) | 5 parts |
| water | 65 parts |

COMPARATIVE EXAMPLE 2

A comparative thermal printing medium was prepared identical to that of Example 1 of the present invention, except that the solution [C] was replaced with the solution [C-2] having the composition listed below.

| Solution [C-2]: | |
|---|---|
| magnesium carbonate (trade name Kinsei: marketed by Kounoshima Chemicals Co.) | 30 parts |
| 30% styrene-mono maleate copolymer ammonium salt solution (trade name Discoat N-14: marketed by Daiichi Kogyoseiyaku Co.) | 5 parts |
| water | 65 parts |

COMPARATIVE EXAMPLE 3

A comparative thermal printing medium was prepared identical to that of Example 1 of the present invention, except that the solution [C] was replaced with the solution C-3] having the composition listed below.

| Solution [C-3]: | |
|---|---|
| clay (trade name Alpha coat: marketed by Anglo-American Clay Co.) | 30 parts |
| 30% styrene-mono maleate copolymer ammonium salt solution (trade name Discoat N-14: marketed by Daiichi Kogyoseiyaku Co.) | 5 parts |
| water | 65 parts |

COMPARATIVE EXAMPLE 4

A comparative thermal printing medium was prepared identical to that of Example 1 of the present invention, except that the solution [C] was replaced with the solution C-4] having the composition listed below.

| Solution [C-4]: | |
|---|---|
| pulverized silica (trade name P-4527D: marketed by Mizusawa Chemicals Co.) | 30 parts |
| 30% styrene-mono maleate copolymer ammonium salt solution (trade name Discoat N-14: marketed by Daiichi Kogyoseiyaku Co.) | 5 parts |
| water | 65 parts |

EXAMPLE 2

A thermal printing medium was prepared identical to that of Example 1 of the present invention, except that 100 parts of the solution [C] was replaced with 30 parts of the solution [C] and 70 parts of solution [C-1]. The composition of the heat sensitive coating was as follows.

| | |
|---|---|
| Dispersed solution [A] | 100 parts |
| Dispersed solution [B] | 30 parts |
| Dispersed solution [C] | 30 parts |
| Dispersed solution [C-1] | 70 parts |
| 25% styrene-acrylic acid-acrylamide copolymer ammonium salt solution (trade name SA-6N-604: marketed by Kindai Chemicals Co.) | 60 parts |

EXAMPLE 3

A thermal printing medium was prepared identical to that of Example 1 of the present invention, except that the solution [A] was replaced with the solution [A-1]. The composition of the solution [A-1] was as follows.

| Solution [A-1]: | |
|---|---|
| 4-hydroxy-4'-benzyloxydiphenylsulfone | 30 parts |
| 30% styrene-mono maleate copolymer ammonium salt solution (trade name Discoat N-14: marketed by | 10 parts |

-continued

| Solution [A-1]: | |
|---|---|
| Kindai Chemicals Co.) | |
| water | 60 parts |

salt solution (trade name Discoat N-14: marketed by

COMPARATIVE EXAMPLE 5

A comparative thermal printing medium was prepared identical to that of Example 1 of the present invention, except that 4-hydroxy-4'-isopropoxydiphenylsulfone of the solution [A] which is the dispersed solution of the color developing agent for the heat sensitive layer was replaced with 2,2-bis(4-hydroxyphenyl)propane.

COMPARATIVE EXAMPLE 6

A comparative thermal printing medium was prepared identical to that of Example 1 of the present invention, except that 4-hydroxy-4'-isopropoxydiphenylsulfone of the solution [A] which is the dispersed solution of the color developing agent for the heat sensitive layer was replaced with benzyl 4-hydroxy benzoate.

COMPARATIVE EXAMPLE 7

A comparative thermal printing medium was prepared identical to that of Example 1 of the present invention, except that 4-hydroxy-4'-isopropoxydiphenylsulfone of the solution [A] which is the dispersed solution of the color developing agent for the heat sensitive layer was replaced with bis(3-allyl-4-hydroxyphenyl)sulfone.

EXAMPLE 4

In order to prepare the heat sensitive coating, solution [D] and solution [E] having the composition listed below were dispersed by sand grinder.

| Solution [D]: | |
|---|---|
| 4-hydroxy-4'-isopropoxydiphenylsulfone | 30 parts |
| 25% styrene-acrylic acid-acrylamide copolymer ammonium salt solution (trade name SA-6N-604: marketed by Kindai Chemicals Co.) | 20 parts |
| aluminum hydroxide (trade name Hygillite H-42: marketed by Showa Denko Co.) | 30 parts |
| water | 120 parts |
| Solution [E]: | |
| 3-N-ethyl-N-isoamylamino-6-methyl-7-anilinofuluorane | 30 parts |
| 10% polyvinyl alcohol solution (trade name PVA203: marketed by Kurare Co.) | 45 parts |
| water | 25 parts |

Moreover, obtained dispersed solutions [D], [E], and another dispersed solution were mixed in the ratio below.

| | |
|---|---|
| Dispersed solution [D] | 200 parts |
| Dispersed solution [E] | 30 parts |
| 25% styrene-acrylic acid-acrylamide copolymer ammonium salt solution (trade name SA-6N-604: marketed by Kindai Chemicals Co.) | 60 parts |

The obtained heat sensitive coating was coated over the wood free paper having a weight of 56 g/m$^2$ which is the substrate, and was dried to form a thermal sensitive layer, such that the dry weight thereof was 6 g/m$^2$.

The protective coating was prepared having the composition listed below:

| | |
|---|---|
| 10% carboxyl modified polyvinyl alcohol solution (trade name Gosenol T-330: marketed by Nippon Gosei Kagaku Co.) | 100 parts |
| 40% china clay aqueous dispersed solution | 20 parts |
| 30% zinc stearate aqueous dispersed solution | 5 parts |
| 20% polyamidoepichlorohydrine resin aqueous solution (trade name Polyfix 203: marketed by Showa Polymer Co.) | 20 parts |
| water | 15 parts |

A thermal printing medium produced by the method of the present invention was prepared by coating the protective coating over the previously prepared heat sensitive layer and drying it to form a protective layer, such that the dry weight thereof was 4 g/m$^2$.

EXAMPLE 5

A thermal printing medium was prepared identical to that of Example 4 of the present invention, except that 4-hydroxy-4'-isopropoxydiphenylsulfone which is the color developing agent of the solution [D] was replaced with 4-hydroxyphenyl-4'-benzyloxydiphenylsulfone.

COMPARATIVE EXAMPLE 8

A comparative thermal printing medium was prepared identical to that of Example 4 of the present invention, except that aluminum hydroxide of the solution [D] was replaced with light calcium carbonate (trade name Brilliant 15: marketed by Shiraishi Industries Co.).

COMPARATIVE EXAMPLE 9

A comparative thermal printing medium was prepared identical to that of Example 4 of the present invention, except that 4-hydroxy-4'-isopropoxydiphenylsulfone of the solution [D] was replaced with 2,2-bis(4-hydroxyphenyl)propane.

COMPARATIVE EXAMPLE 10

A comparative thermal printing medium was prepared identical to that of Example 4 of the present invention, except that 4-hydroxy-4'-isopropoxydiphenylsulfone of the solution [D] was replaced with benzyl 4-hydroxy benzoate.

The thermal printing media prepared in Examples 1 to 5 and Comparative Examples 1 to 10, were evaluated in the manner explained below. The results are shown in table 1.

1. Printing density

Using a thermal printer (produced by Matsushita Electric, Inc.), thermal printing at an electrical printing power of 0.5W/dot and pulse width of 1.0 msec was carried out using each of the example sheets of thermal printing media of the present invention and comparative example sheets of thermal printing media prepared as described above. Printing densities were then evaluated using a Macbeth RD-914 reflective densitometer.

2. Background density

Background densities were evaluated using a Macbeth RD-914 reflective densitometer.

3. Water resistance

Using a label printer (produced by Teraoka, Inc.), printed samples were prepared. After the printed samples were submerged in water at 25° C. for 24 hours, printing densities thereof were evaluated using the Macbeth RD-914 reflective densitometer. The water resistances thereof were evaluated by survival rates calculated from the formula indicated below.

Water resistance (Survival rate, %) = (Printing density of the thermal printing medium which was submerged in water/Printing density of the thermal printing medium which was not submerged in water) × 100

4. Resistance to water dissolved plasticizer

Using a label printer (produced by Teraoka, Inc.), printed samples were prepared. The printed samples were submerged in water added wrap for food (trade name Diawrap G, marketed by Mitsubishi Resin Co.) at 25° C. for 24 hours. 1 g of the wrap for food per 1 liter of water was added. Then, printed densities on the thermal printing media were evaluated using the Macbeth RD-914 reflective densitometer. The resistances to water dissolved plasticizer of the thermal printing media were evaluated by survival rates calculated from the formula indicated below.

Resistance to water dissolved plasticizer (Survival rate, %) = (Printing density of the thermal printing medium which was submerged in water/Printing density of the thermal printing medium which was not submerged in water) × 100

5. Oil resistance

Using a label printer (produced by Teraoka, Inc.), printed samples were prepared The surface of the printed samples were coated with castor oil at 40° C. After the printed samples were allowed to stand for 24 hours, printed densities of the thermal printing media were evaluated using the Macbeth RD-914 reflective densitometer. The oil resistances of the thermal printing media were evaluated by the survival rate calculated from the formula indicated below.

Oil resistance (Survival rate, %) = (Printing density of the thermal printing medium which was oil-coated and allowed to stand/Printing density of the thermal printing medium which was not oil-coated) × 100

TABLE 1

| | Printing density | Back-ground density | Water resistance (%) | Resistance to water dissolved plastici-zer (%) | Oil resis-tance (%) |
|---|---|---|---|---|---|
| Example 1 | 1.37 | 0.06 | 91.0 | 88.0 | 99.0 |
| Example 2 | 1.36 | 0.06 | 90.0 | 84.2 | 97.0 |
| Comparative Example 1 | 1.28 | 0.07 | 65.0 | 60.0 | 90.0 |
| Comparative Example 2 | 1.25 | 0.08 | 66.4 | 61.2 | 92.0 |
| Comparative Example 3 | 1.15 | 0.12 | 55.0 | 48.0 | 86.0 |
| Comparative Example 4 | 1.29 | 0.09 | 40.0 | 35.2 | 78.0 |
| Example 3 | 1.35 | 0.06 | 88.0 | 86.0 | 97.8 |
| Comparative Example 5 | 1.15 | 0.14 | 42.0 | 30.0 | 78.0 |
| Comparative Example 6 | 1.35 | 0.06 | 48.0 | 40.5 | 56.0 |
| Comparative Example 7 | 0.98 | 0.18 | 88.5 | 84.0 | 97.2 |

TABLE 1-continued

| | Printing density | Back-ground density | Water resistance (%) | Resistance to water dissolved plastici-zer (%) | Oil resis-tance (%) |
|---|---|---|---|---|---|
| Example 4 | 1.49 | 0.05 | 93.0 | 91.2 | 100 |
| Example 5 | 1.47 | 0.05 | 92.0 | 90.0 | 100 |
| Comparative Example 8 | 1.30 | 0.08 | 65.2 | 61.0 | 91.0 |
| Comparative Example 9 | 1.18 | 0.17 | 43.0 | 31.2 | 87.0 |
| Comparative Example 10 | 1.49 | 0.08 | 50.0 | 41.5 | 79.0 |

As is clear from Table 1 above, the thermal printing media of the present invention exhibit improved thermal printing sensitivity as evidenced by the printing density, high whiteness of the background, superior water resistance, and resistance to water dissolved plasticizer, as well as excellent chemical resistance. Moreover, the thermal printing media of examples 4 and 5 prepared in a method of the present invention even exhibit excellent printing sensitive (printing density) and printing stability (water resistance, resistance to water dissolved plasticizer, and oil resistance).

What is claimed is:

1. A thermal printing medium comprising a substrate having an upper and lower surface;

a heat sensitive layer formed over at least one surface of said substrate and including at least one of a colorless and a lightly colored leuco dye, and a color developing agent which imparts color to said leuco dye; and a protective layer comprised of aqueous resin and filler agent as main components thereof;

characterized in that said heat sensitive layer is comprising at least one compound indicated by formula (1)

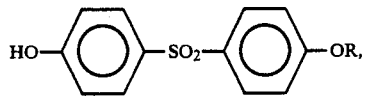

(1)

wherein R indicates an alkyl group having 1 to 10 carbon atoms or a benzyl group which may have a substitutional group, as a color developing agent, and aluminum hydroxide.

2. A thermal printing medium in accordance with claim 1, wherein said color developing agent and aluminum hydroxide are included in the heat sensitive layer in a ratio 100 : 10 to 300.

3. A thermal printing medium in accordance with claim 2, wherein said ratio of color developing agent to aluminum hydroxide is 100 : 20 to 150.

4. A thermal printing medium in accordance with claim 1, wherein said color developing agent is 4-hydroxy-4'-isopropoxydiphenylsulfone.

5. A method for preparing a thermal printing medium comprising the steps of:

forming a heat sensitive layer over at least one surface of said substrate, said heat sensitive layer including at least one of a colorless and a lightly colored leuco dye, and a color developing agent which imparts color to said leuco dye;

forming a protective layer over said heat sensitive layer, which is comprised of an aqueous resin and a filler agent;

characterized in that in forming a heat sensitive layer, a coating for forming the heat sensitive layer is prepared by blending a dispersed solution ground using a wet grinding machine, said dispersed solution comprising at least one compound indicated by formula (1)

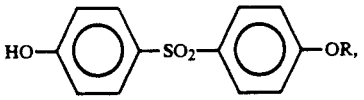

(1)

wherein R indicates an alkyl group having 1 to 10 carbon atoms or a benzyl group which may have a substitutional group, as a color developing agent, aluminum hydroxide, and a dispersant.

6. A method for preparing a thermal printing medium according to claim 5, wherein said dispersant is at least one kind of ammonium salt selected from the group comprising (di)isobutylene-maleic anhydride copolymer, styrene-mono maleate copolymer, styrene-(meta)acrylic acid copolymer, and styrene-(meta)acrylic acid-(meta)acrylamide copolymer.

* * * * *